US009457610B2

(12) United States Patent
Hagadorn et al.

(10) Patent No.: US 9,457,610 B2
(45) Date of Patent: Oct. 4, 2016

(54) DYNAMIC PRESCRIPTION DISPENSING CHECKLIST SYSTEMS AND METHODS

(71) Applicants: Colleen A. Hagadorn, Queensbury, NY (US); Kathleen A. Bauer, Brant Lake, NY (US)

(72) Inventors: Colleen A. Hagadorn, Queensbury, NY (US); Kathleen A. Bauer, Brant Lake, NY (US)

( * ) Notice: Subject to any disclaimer, the term of this patent is extended or adjusted under 35 U.S.C. 154(b) by 323 days.

(21) Appl. No.: 13/804,385

(22) Filed: Mar. 14, 2013

(65) Prior Publication Data

US 2013/0264352 A1 Oct. 10, 2013

Related U.S. Application Data

(60) Provisional application No. 61/610,633, filed on Mar. 14, 2012.

(51) Int. Cl.
*B42D 15/00* (2006.01)
*A61J 7/04* (2006.01)
*A61G 12/00* (2006.01)

(52) U.S. Cl.
CPC ..... *B42D 15/00* (2013.01); *A61G 12/00* (2013.01); *A61J 7/04* (2013.01); *A61G 2205/30* (2013.01)

(58) Field of Classification Search
CPC .... B42D 15/00; B42D 15/10; B42D 15/004; G09F 3/0288; G09F 3/00; G09F 7/04; G09F 1/10; G09F 3/20; G09F 7/18; G09F 2007/1852; A61J 7/04; G09B 29/00; A41H 3/06; G06G 1/14; B43L 1/06
USPC ..... 40/661.01; 283/115, 900; 434/416
See application file for complete search history.

(56) References Cited

U.S. PATENT DOCUMENTS 4,584,223 A * 4/1986 Krapf ..... G09B 29/002 428/192
5,102,169 A * 4/1992 Mayfield ..... 283/115
5,178,573 A * 1/1993 Smith ..... A63H 3/08 428/16
5,261,702 A * 11/1993 Mayfield ..... 283/115
5,431,450 A * 7/1995 Coleman ..... 283/62

(Continued)

OTHER PUBLICATIONS

Pre-Cut Colored Magnet Ribbon, available from OptiMA, Inc. MyWhiteboards.Com, Shrewsbury, MA, printout available online on Apr. 27, 2013, at http://mywhiteboards.com/precmagrib.html, 4-pages, at least as early as 2007.

(Continued)

*Primary Examiner* — Cassandra Davis
(74) *Attorney, Agent, or Firm* — Heslin Rothenberg Farley & Mesiti P.C.

(57) ABSTRACT

A system includes a board comprising a first surface comprising an area identified for allowing a user to identify prescriptions, an area identified for allowing a user to identify times for taking the prescription, and an area identified for allowing a user to removably mark the board upon dispensing pills into a weekly or monthly pill organizer. A first plurality of strips movably and releasably is attachable to the first surface of the board in the area identified for labeling prescription medications. The first plurality of strips comprises a front surface operable for allowing a user to removably label prescription medications. A second plurality of strips is movably and releasably attachable to the first surface of the board in the area identified for labeling times for taking the prescription medications. The second plurality of strips comprising a front surface operable for allowing a user to removably label times for taking the prescription medications.

20 Claims, 9 Drawing Sheets

(56) References Cited

U.S. PATENT DOCUMENTS

| | | | | | |
|---|---|---|---|---|---|
| 5,573,405 | A * | 11/1996 | Evans | 434/238 | |
| 5,810,395 | A * | 9/1998 | Morgan | 283/70 | |
| 5,994,990 | A * | 11/1999 | Ogikubo | G09B 9/14 | 335/285 |
| 6,231,023 | B1 * | 5/2001 | Morton | 248/441.1 | |
| 6,484,428 | B1 * | 11/2002 | Greenwald | G09F 7/04 | 40/124.04 |
| 7,240,793 | B2 * | 7/2007 | McBain | 206/534 | |
| D555,724 | S * | 11/2007 | Brodie | D19/21 | |
| 7,320,483 | B2 * | 1/2008 | Eippert | 283/67 | |
| D562,408 | S | 2/2008 | Loerakker | | |
| 2006/0070895 | A1 * | 4/2006 | Khawaja | 206/223 | |
| 2012/0200208 | A1 | 8/2012 | Hagadorn et al. | | |
| 2012/0200209 | A1 | 8/2012 | Hagadorn et al. | | |

OTHER PUBLICATIONS

Medical Boards, available from billyBoards, Lake Barrington, Illinois, printout available online on Apr. 27, 2013, at http://www.billyboardsmfg.com/dryeraseboards.html, 6-pages, at least as early as 2008.

Healthcare Whiteboards, available from VividBoard, Lebanon, Ohio, printout available online on Apr. 27, 2013, at http://www.vividboard.com/products/healthcare/, 2-pages, at least as early as Aug. 2010.

Push Button 4X/Day Weekly Pill Organizer—Item 781, available from ForgettingThePill.com, Algoma, Wisconsin, printout available online on Apr. 27, 2013, at http://www.forgettingthepill.com/products/push-button-4xday-weekly-pill-organizer, 3-pages, at least as early as Apr. 2009.

* cited by examiner

100

126

| REFILL NEEDED | PRESCRIPTION NAME | $R_X$ REFILL # | PRESCRIBING DR. NAME AND PHONE # | PHARMACY NAME AND PHONE # |
|---|---|---|---|---|
| | AMOXYCILLIN | 123 | DR. A 555-0011 | CVS 555-0000 |
| | DEXAMETHASONE 2mg | 1234 | DR. B 555-5555 | CVS |
| | FAMOTIDINE 20mg | 12345 | DR. A 555-0011 | CVS |
| | FUROSEMIDE 40mg | 123456 | DR. B 555-5555 | CVS |
| | | | | RITE AID 555-9999 |
| | LANTOVEN 5.0mg | 1234567 | DR. A 555-0011 | CVS |
| | KEPRA 1000mg | 123456789 | DR. D 555-1111 | CVS |
| | KLOR-CON 20mg | 234 | DR. A 555-0011 | RITE AID |
| | LISINOPRIL 5mg | 0234 | DR. A 555-0011 | CVS |
| | METROPROLOL 100mg | 0235 | DR. E 555-2222 | WALGREENS 555-8888 |
| | PREVASTATIN 40mg | 0236 | DR. A 555-0011 | RITE AID |
| | PROCHLORPRAZINE | 0237 | DR. F 555-3333 | CVS |
| | TEMODAR 100mg | 0238 | DR. A 555-0011 | CVS |
| | TEMODAR 20mg | 0239 | DR. G 555-4444 | CVS |

124

*FIG. 4*

DYNAMIC PRESCRIPTION DISPENSING CHECKLIST SYSTEMS AND METHODS

CLAIM TO PRIORITY

This application claims the benefit of U.S. Provisional Application No. 61/610,633, filed Mar. 14, 2012, entitled "Dynamic Prescription Dispensing Checklist Systems and Methods", which is hereby incorporated in its entirety herein by reference.

FIELD OF THE INVENTION

This disclosure relates generally to dispensing of prescription medications, and more specifically, to dynamic prescription dispensing checklist systems and methods.

BACKGROUND OF THE INVENTION

One procedure for filling weekly or monthly pill organizers is to go through, one by one, the various prescription bottles, read the labels, and place the pills in the container portions of the weekly or monthly pill organizer. The process is then repeated once the weekly or monthly pill organizer is empty.

There is a need for dispensing of prescription medications, and more specifically, to dynamic prescription dispensing checklist systems and methods for dispensing of prescription medications.

SUMMARY OF THE INVENTION

In a first aspect, the present disclosure provides a dynamic prescription dispensing checklist system for use in filling a weekly or monthly pill organizer. The system includes a board comprising a first surface having an area identified for allowing a user to identify prescriptions, an area identified for allowing a user to identify times for taking the prescription, and an area identified for allowing a user to removably mark the board upon dispensing pills into a weekly or monthly pill organizer. A first plurality of strips is movably and releasably attachable to the first surface of the board in the area identified for identifying prescription medications. The first plurality of strips comprises a front surface operable for allowing a user to removably label prescription medications. A second plurality of strips is movably and releasably attachable to the first surface of the board in the area identified for identifying times for taking the prescription medications.

In a second aspect, the present disclosure provides a method for use in filling a weekly or monthly pill organizer. The method includes providing the dynamic prescription dispensing checklist system noted above, obtaining a plurality of prescription medication pill bottles comprising pills for dispensing over a week or month, labeling a name of the prescription medications on some of the first plurality of strips, labeling times during the day for taking the prescription medications on the second plurality of strips, and placing the labeled first plurality of strips and the labeled second plurality of strips on the board so that the prescription medications of first plurality of strips for a day are coordinated with the times of the second plurality of strips. The method also includes removing a plurality of first pills from a first of the prescription pill bottles, placing the plurality of first pills in respective container portions of a weekly or monthly pill organizer corresponding to the prescription medication and time identified on the dynamic prescription dispensing checklist system, marking the dynamic prescription dispensing checklist system to identify that the first plurality of pills has been dispensed into the weekly or monthly pill organizer, repeating the steps of removing, placing, and marking for the remaining plurality of prescription pill bottles, removing the markings after completing the dispensing of the plurality of pills into the weekly or monthly pill organizer, removing the plurality of pills from the weekly or monthly pill organizer over the course of the week or month, and repeating the steps of removing, placing, and marking to refill the pill organizer for the next weekly or monthly pill organizer.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

FIG. 4 is another embodiment of a perspective view of a rear side of the dynamic prescription dispensing checklist system of FIG. 1;

DETAILED DESCRIPTION OF THE INVENTION

The present disclosure is directed to providing a flexible system for people (patients and/or caregivers) to use as they allocate and keep track of pills (prescription or vitamin) into a weekly or monthly pill container. As described below, the system is dynamic and can easily be changed to accommodate and reflect any changes made by doctors to a patient's medication regimen. The present disclosure may, if not always, contain the most current medication regimen that a patient is on, if it is utilized accordingly.

Figure 1:
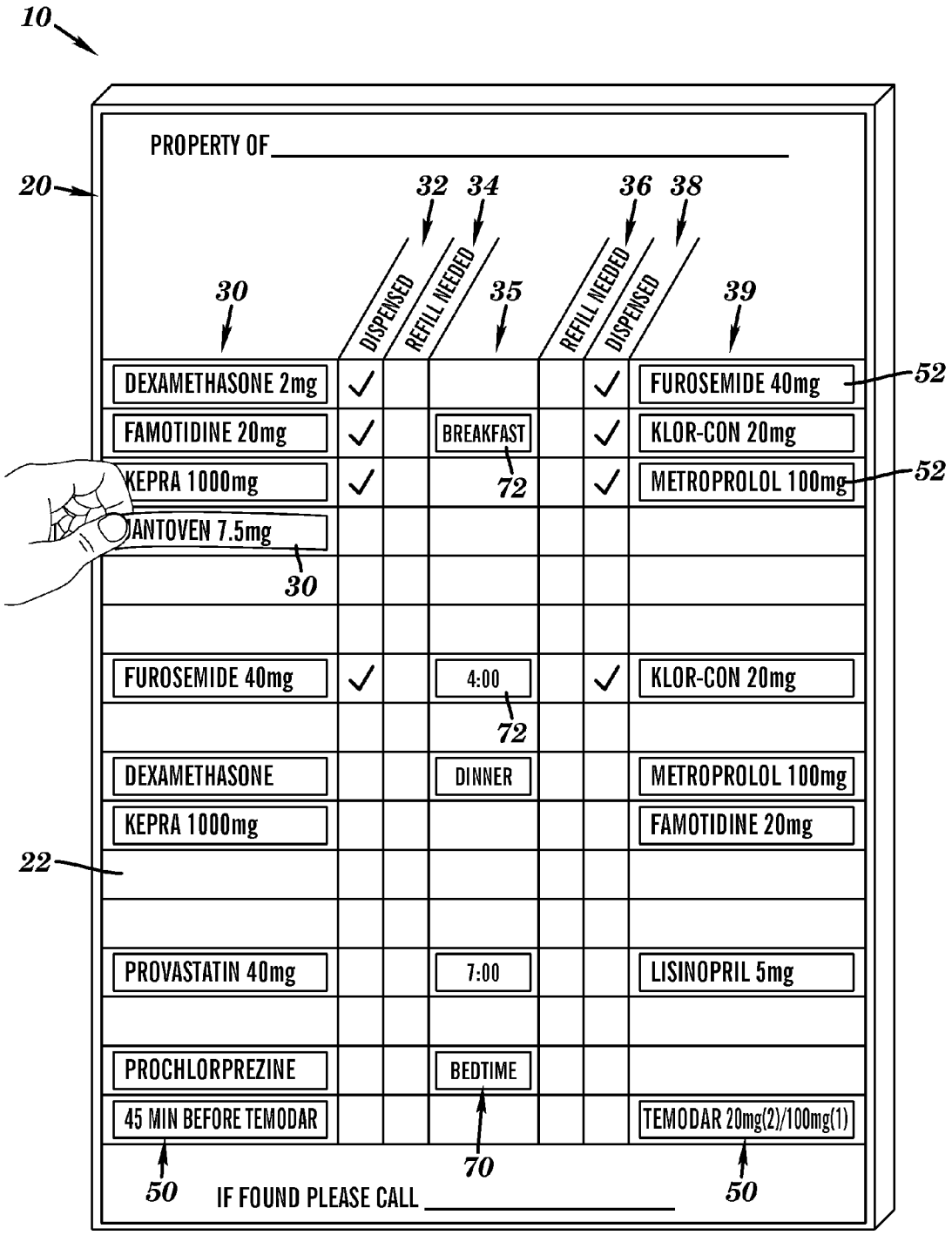
FIG. 1 is a perspective view of one embodiment of a dynamic prescription dispensing checklist system in accordance with aspects of the present disclosure.

FIG. 1 illustrates one embodiment of a dynamic prescription dispensing checklist system 10 in accordance with aspects of the present disclosure. System 10 includes a board 20 and a first plurality of removable strips 50 and a second plurality of removable strips 70. Board 20 may include a front surface 22 and a rear surface (not shown in FIG. 1). For example, board 20 may be a generally rectangular-shaped magnetic whiteboard. The board may further include a plurality of columns such as a first column 30, a second column 32 identified "Dispensed", a third column 34 identified "Refill Needed", a fourth column 35, a fifth column 36 identified "Refill Needed", a sixth column 38 identified "Dispensed", and a seventh column 39. The identified columns 32, 34, 36, and 38 may be divided to allow the user to add indicia such as a check mark or an X as disclosed in greater detail below. For example, the identified terms may be generally permanently preprinted on the board. The board may have a width of about 9 inches and a length of about 12 inches, or any suitable size or shape.

Each of the plurality of removable strips 50 may have a front surface 52 and a rear surface (not shown in FIG. 1). For example, removable strips 50 may be a plurality of colored magnetic strips that a user may write on to indicate medication type and dosage. Plurality of removable strips 50 may be placed in column 30 or 39. Each of the plurality of removable strips 70 may have a surface side 72 and a rear surface (not shown in FIG. 1). For example, removable strips 70 may be a plurality of colored magnetic strips that a user may write on to indicate a time or period during the day such as "Breakfast", "Lunch", Dinner", or "Bedtime-."Plurality of removable strips 70 may be placed in column 35. The plurality of magnetic strips may be placed on the pre-printed magnetic whiteboard and can be changed periodically to coincide with any changes that occur within a patient's prescription regimen. In addition, removable strips 70 may be preprinted with information such as a time or period during the day such as "Breakfast", "Lunch", Dinner", or "Bedtime."

With reference still to FIG. 1, the magnetic whiteboard may include seven columns. For example, columns 30 and 39 disposed along the sides of the board may be blank, and the center column 35 may be blank. The outer columns 30 and 39 may be wider than the center column 35, and the center column 35 may be wider than the combined adjacent columns 32 and 34, and combined adjacent columns 36 and 38. Columns 32, 34, 36, and 38 may be divided into permanently preprinted boxes. The plurality of removable strips 70 containing words such as "breakfast", "lunch", "dinner", "bedtime" or, actual times such as "4:00", "7:00", etc. can be placed anywhere in column 35, allowing for a customized chart for an individual person, based on when he/she takes his/her medications. The outside columns 30 and 39 are the areas where, for example, the colored magnetic strips may be placed with names and dosages of medications. The schedule may be color-coordinated by times (breakfast—yellow, lunch—grey, etc.), or multiple patients' schedules on one board could be color-coordinated for each individual (husband—white, wife—yellow). The pens used to label the magnetic strips may be semi-permanent, e.g., they do not smudge when touched, but may be wiped clean with a damp cloth. The magnetic board may include a place for the name of the patient and a contact number if found. The magnetic strips may be formed from flexible, soft magnetic backing material or layer, and a front polymeric or plastic material or layer. In addition, an elongated strip of material may be provided may be trimmable by user to a desired size.

Figure 2:
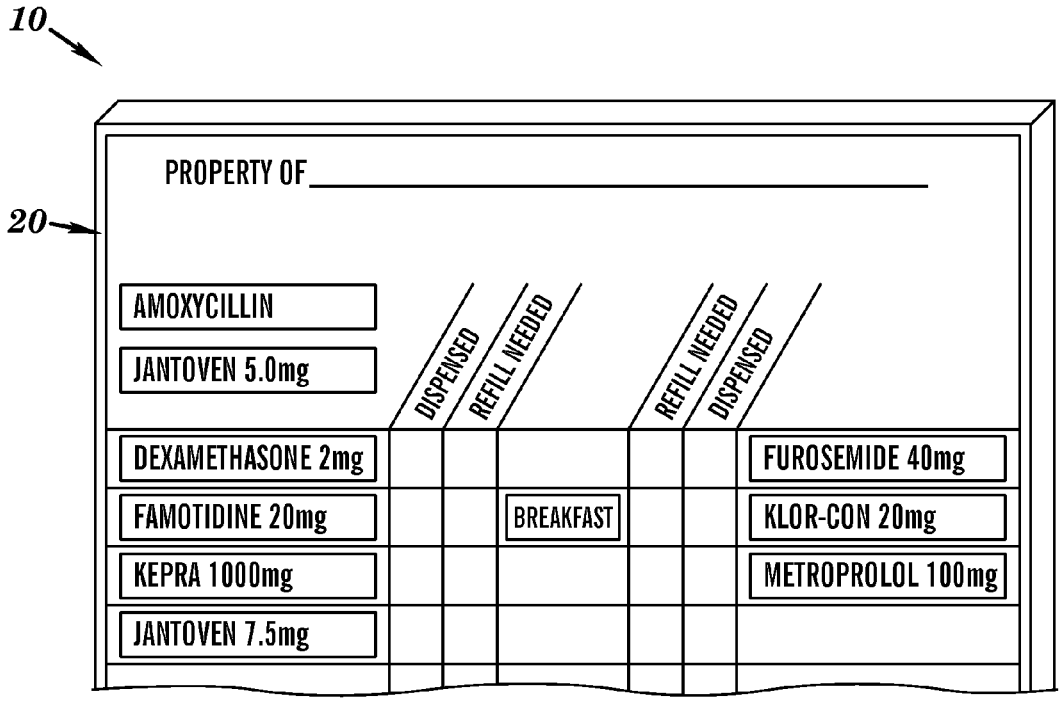
FIG. 2 is a perspective view of the top portion of the dynamic prescription dispensing checklist system of FIG. 1.

FIG. 2 illustrates the top portion of system 10. For example, additional strips for prescriptions labeled "Amoxycillin" and "Jantoven" may be placed at the top of board 20. These strips can be stored on the board and added to the working section whenever necessary, or the patient or caregiver may place these strips on a refrigerator and add them to the board when necessary.

In addition, additional strips when not in use may be attached or stored on the rear side as described below. The Jantoven 5 mg is a different dosage than the Jantoven 7.5 mg located on the schedule in the working section of the board, and the 5 mg can be exchanged with 7.5 mg as necessary.

Figure 3:
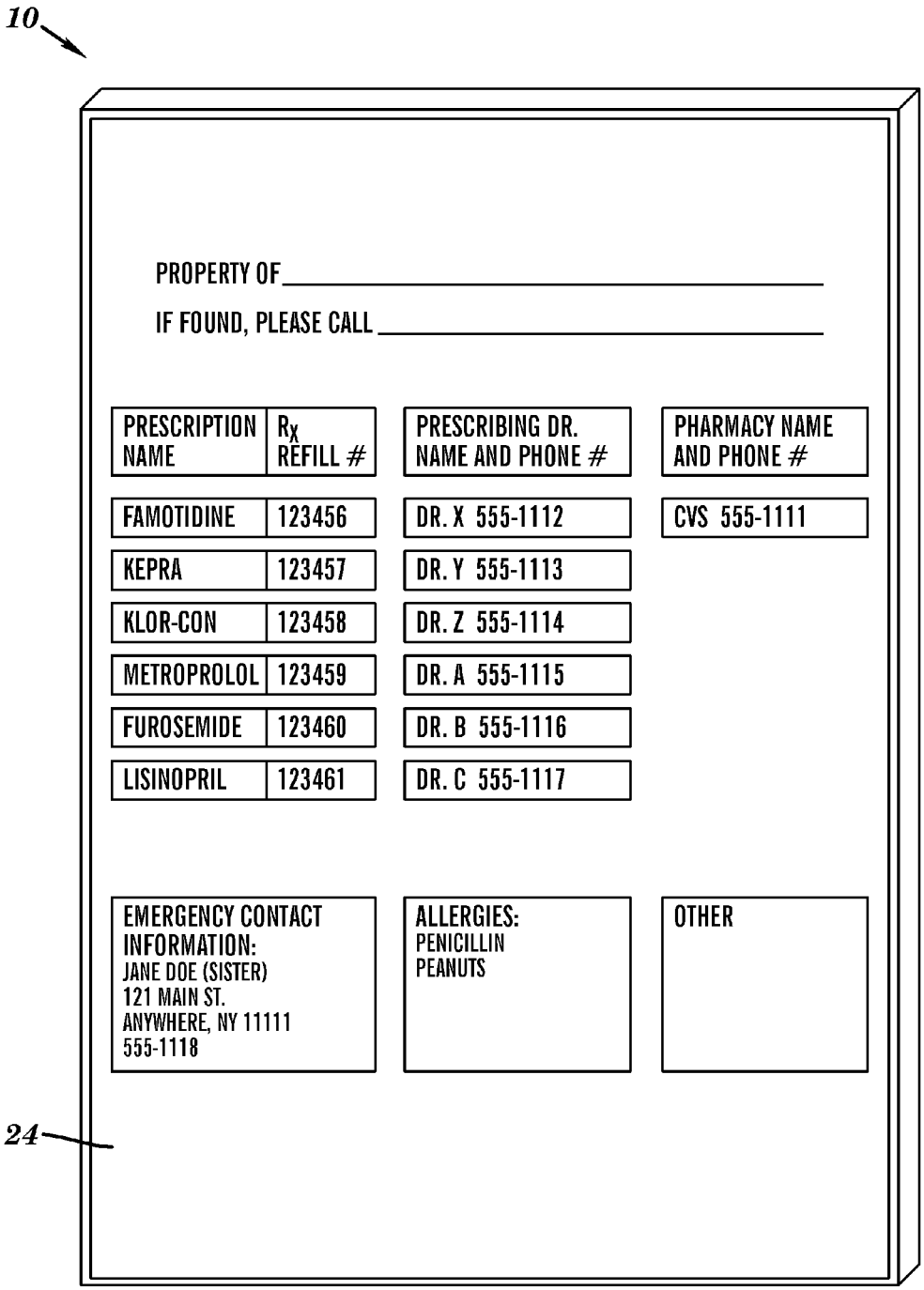
FIG. 3 is a perspective view of a rear side of the dynamic prescription dispensing checklist system of FIG. 1.

FIG. 3 illustrates a rear side 24 of dynamic prescription dispensing checklist system 10. Information provided on the rear side may include information relating to pharmacy phone numbers, prescription refill numbers, doctor phone numbers, emergency contact information and allergies, and other information. The rear side may be a writable/erasable board, a writable/erasable magnetic board, or other type of board. For example, pharmacy phone numbers, prescription refill numbers, doctor phone numbers, emergency contact information and allergies, or other information, may be written on directly on the rear surface of the board. Where the board is magnetic, pharmacy phone numbers, prescription refill numbers, doctor phone numbers, emergency contact information and allergies, or other information, may be written on magnetic strips and magnetically attached to the board. In addition, it will be appreciated that a user may place some of the information to be placed on the strips while other information (e.g., emergency contact number, allergies, etc.) may be placed on the board instead of the strips.

FIG. 4 is another embodiment of a rear side 124 of a dynamic prescription dispensing checklist system 100. For example, rear side 124 may include a listing of the patient's medication regimen. The medication regimen may be listed in a horizontal format (as shown) or in a vertical format (not shown). For the medication regimen, various columns may be permanently labeled such as columns for the "Prescription Name", "Prescription Refill No.", "Prescribing Doctor and Telephone No.", and "Pharmacy Name and Telephone No." The patient or caregiver may write various information pertaining to the medication regimen using for example, a pen or marker that does not smudge when touched, but may be wiped clean with a damp cloth. The rear side may be a writable/erasable board, a writable/erasable magnetic board, or other type of board. The written information may be written directly on the rear side, written on strips such as magnetic strips attachable to the rear surface, or a combination thereof. In addition, the rear side may be a washable and/or a magnetic surface that may be blank allowing a patient or caregiver to use, label, and provide any desired information, such as listing of allergies, contact information in case of emergency, etc.

With reference still to FIG. 4, the rear side of the board may include a plurality of first strips containing the medicine name and a plurality of second strips showing the prescription number. It may be desirable and more convenient to have a single longer strip that fits across the board so a patient or caregiver can include the medicine name and the prescription number on the single strip. If a medication is to be removed from the regimen, the patient or caregiver would then just need to take one strip off. This may reduce the likelihood of the chance of mixing up medications and refill numbers if they were kept on separate strips, for example, if a person pulls the medication off, but leaves the other strip with the wrong refill number.

As shown in FIG. 4, a column 126 may be provided on the rear side of the board to the left of each of the labeled strips. Column 126 may be provided with a plurality of lines that allow for transferring information for example, information regarding "Refill Needed", from the front side of the board to the rear side of the board to facilitate calling in refills. As a person dispenses pills into the containers, he/she marks in the "Refill Needed" section (front side) that a refill is needed. When a person finishes dispensing all pills and identifies which medications need to be refilled, he/she may flip dynamic prescription dispensing checklist system 100 over to the rear side of the board and place a check or X in the column that is associated with the labeled strip of the specific medication that needs to be refilled. He/she then repeats this procedure for each medication that needs to be refilled (as noted on the front side of the board in the "Refill Needed" section). Once all of the medications that need to be refilled are identified on the rear side (checked boxes), the person can then call in the refills without flipping back and forth from front to back. Once the refills are called in, the column may be erased or wiped clean, and can be used again when the person dispenses the medications again.

Figure 5:
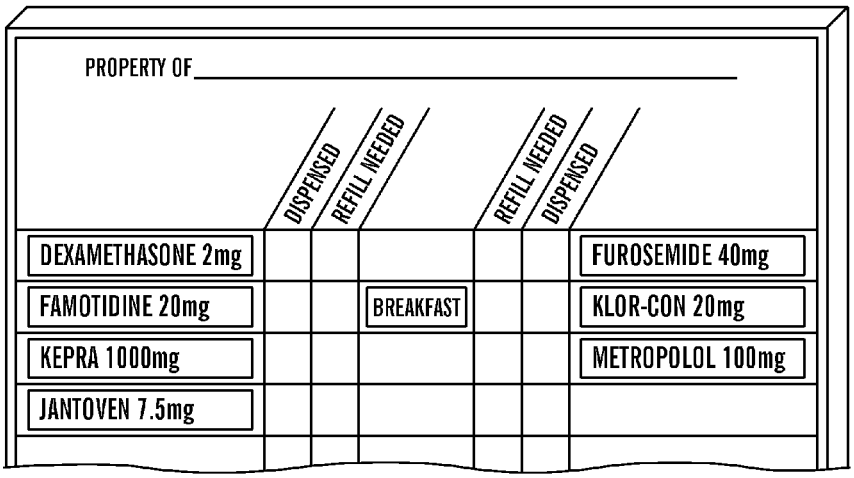
FIGS. 5-7 illustrate a process of replacing one dosage with another dosage on the dynamic prescription dispensing checklist system of FIG. 1 in accordance with aspects of the present disclosure.
Figure 6:
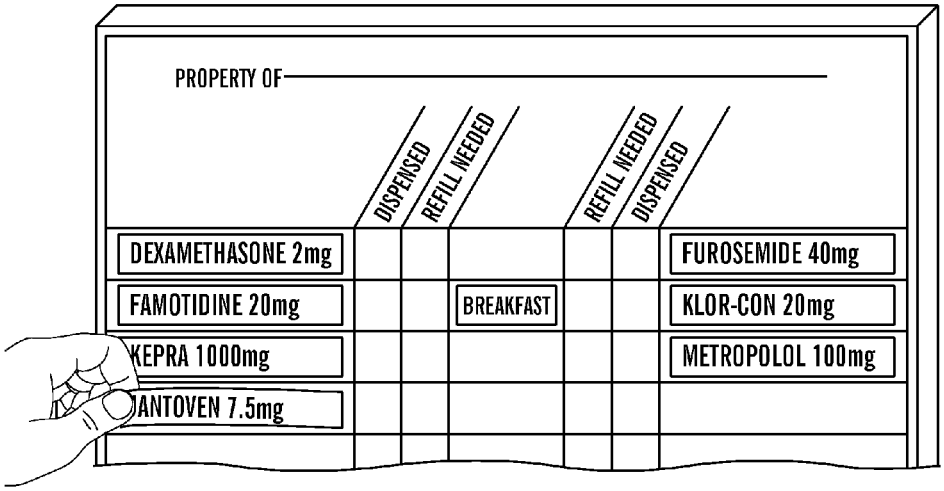
Figure 7:
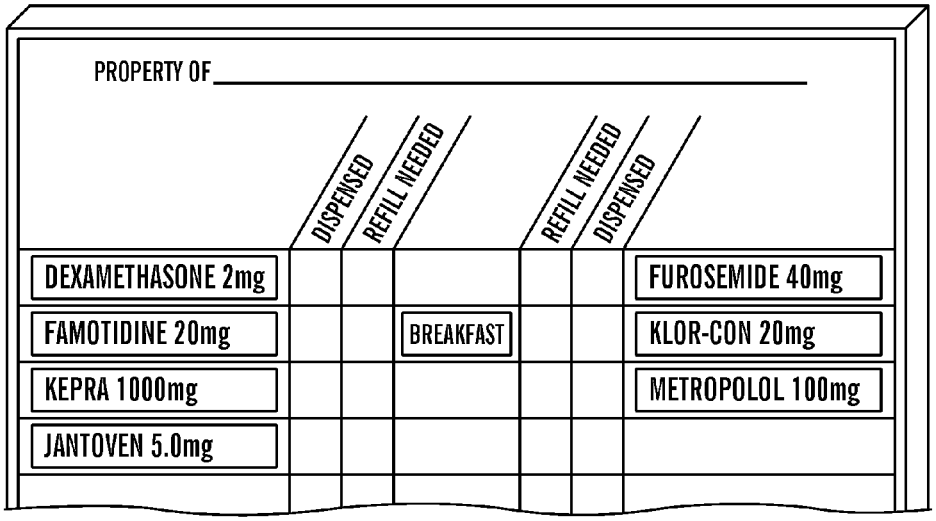

FIGS. 5-7 illustrate the process of replacing one dosage with another dosage on the dynamic prescription dispensing checklist system of FIG. 1. For example, medication Jantoven 7.5 mg shown in FIG. 5 is removed as shown in FIG. 6, and replaced with Jantoven 5.0 mg as shown in FIG. 7.

Figure 8:
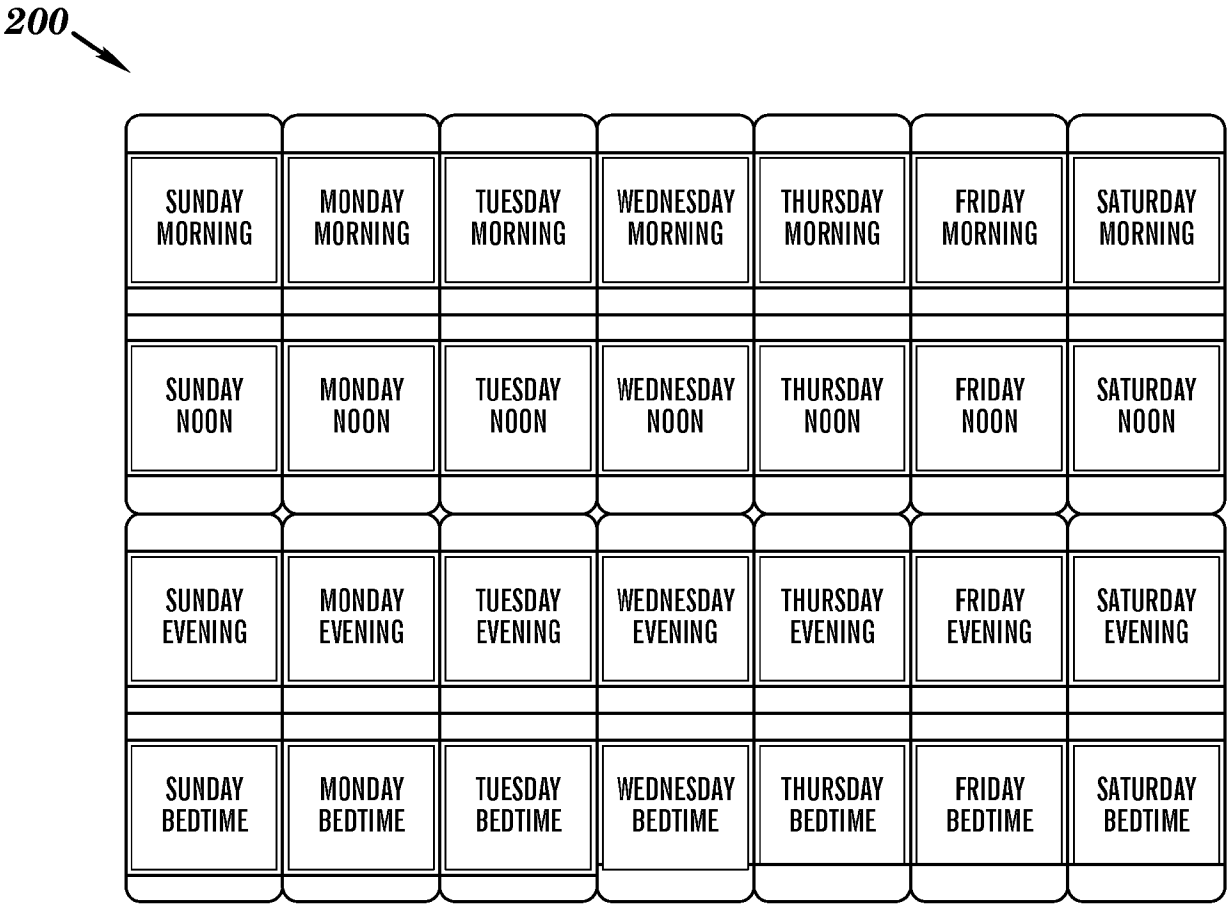
FIG. 8 is a plan view of a weekly pill organizer for use with the dynamic prescription dispensing checklist system of FIG. 1.

FIG. 8 illustrates a weekly pill organizer 200 for use with dynamic prescription dispensing checklist system 10 (FIG. 1) having compartment for morning, noon, evening, and bedtime.

In one aspect, with reference to FIGS. 1 and 8, the present disclosure employs magnetic strips labeled with medication name and dosage that are placed onto a magnetic whiteboard. Permanently pre-printed boxes on the whiteboard, for example, next to, and associated with each strip, are available for a person to place a checkmark into when the medication has been allocated into a weekly or monthly container.

For example, while allocating medication, a patient or caregiver would place pills into daily compartments of a container and then place a checkmark in the "Dispensed" box that is in line with the magnetic strip labeled with that medication, when the allocation was completed. If the pill quantity is low, the patient or caregiver would place a checkmark in the "Refill Needed" box, thus aiding in the management of the medication regimen. This procedure would be repeated for all medications on the chart. When all medications are allocated and refills called in, the patient or caregiver may easily wipe off the checkmarks, leaving the permanently marked columns and boxes empty for the next time the medications are allocated into the monthly/weekly container.

If a medication dosage is changed, a new magnetic strip may be inserted to replace the old one. If a new medication is added, a new magnetic strip may be simply added to the appropriate section such as "Bedtime", "Breakfast", etc. If a person is taken off a medication, the magnetic strip may be simply removed and may be erased or saved for future use in case the person is put back on the medication. If a medication is prescribed intermittently, such as antibiotics or chemotherapy, the magnetic strip can be stored on a refrigerator or other metal device and added to the chart/schedule when necessary.

The present disclosure addresses the problems associated with prescription management for patients who are responsible for allocating and taking their own medications, or prescription management for caregivers for aiding patients. For example, the present disclosure provides a management system for patients or their caregivers to accurately allocate medications into a weekly/monthly container, thus potentially reducing the likelihood of potential medication mix-ups.

This present disclosure is particularly helpful for patients who take multiple prescriptions that may change frequently, such as dosage changes or on-off medication regimens. If a patient or caregiver uses a typed or otherwise permanent checklist, then any regimen or prescription changes would require a new checklist to be created. If a patient or caregiver just scratches in a change in medication on a permanent checklist, this could open up opportunities for mistakes to be made. The present disclosure solves this problem because the checklist includes magnetic strips that may be added or removed quickly and conveniently.

Examples of how this system solves some problems associated with prescription management include the following. In a first example, Coumadin is a blood thinning drug that must be monitored carefully. A patient on Coumadin may need to have blood work done weekly and the patient may have to change the dosage on a weekly basis as the blood tests indicate. The present disclosure allows the patient or caregiver to remove and store the magnetic strip with the current Coumadin dosage and replace it with a new one. This can easily be done each week if necessary.

In a second example, cancer patients may be on chemotherapy for a period of time, then off of it, and then back on it. Cancer patients may also be on and off antibiotics as well, due to secondary infections that set in due to weakened immune systems (a side-effect of the chemotherapy drugs). The present disclosure allows a patient or caregiver to easily add or remove chemotherapy drugs and/or antibiotics to the schedule on the magnetic board as necessary. All of this can be done without having to re-write or recreate an entirely new checklist.

It is also possible that, if the number of medications prescribed are not too numerous, the present disclosure may be used by two people in a household, e.g., one person could utilize the left half of the board, while the other person could utilize the right half of the board. Or, two separate boards could be customized for two people in a household, thereby meeting each person's needs and possibly reducing medication mix-ups.

The present disclosure also includes an area to convey and easily locate other helpful information, e.g., located on the back side of the board, such as phone numbers of doctors and pharmacies, $R_x$ numbers for refills, allergy information, emergency contact information, etc. The present disclosure helps the patient or caregiver efficiently manage the process of allocating medications, refilling medications, and monitoring changes made to the medication regimen.

In addition, the present disclosure offers advantages over regular whiteboards that may be used for the same purpose because the writing on a regular whiteboard can smudge easily with only a slight touch from a person or object. A patient could use permanent markers to avoid this, however, they would have to use a highly odorous solvent (such as nail polish remover) to remove any items that need to removed or changed. While removing or changing an unwanted portion from the whiteboard, it is possible and likely that other wanted items could accidentally and unintentionally be disturbed or erased. All of these examples are time-consuming and unpleasant (in terms of odor). The dynamic prescription checklist system likely offers a more convenient and efficient alternative method of monitoring the allocation of pills.

Further, the present disclosure would allow the patient, caregivers, or EMTs to effectively communicate with doctors regarding medications taken by the patient because the dynamic prescription dispensing checklist system would contain the most up-to-date information regarding medications that the patient is taking. It would also facilitate care in an emergency situation, e.g., if the patient could not speak for him/herself, if the dynamic prescription dispensing checklist system was found and used by EMTs, or if a caregiver needed to communicate information to the medical staff involved in the care of the patient. The magnetic nature of the system keeps the strips in place and makes the board very portable. Many people take their medications with them to hospitals, emergency room visits, or to doctor visits. The board would eliminate the need to physically take the medications because it would contain the patient's most up-to-date prescription history.

From the present description, it will be appreciated that a pen or other writing device may be provided for labeling the plurality of strips and marking the various boxes. In one aspect, the labeled prescriptions or labeled items may be washable or erasable. For example, the labeled prescriptions or labeled times may be generally smudge proof and require water or a solvent for erasing or removal. In addition, the labeled prescriptions or labeled times may be generally smudge proof and require removal using a solvent such as an organic solvent such as containing acetone. It is also appreciated that the labeling may be done using permanent markers, and the strips may be disposable and replaceable. It will also be appreciated that other means for movably attaching the strips to the board may be suitably employed. For example, the board and strips may operably include hook-and-loop fasteners such as VELCRO, or a releasable adhesive, for releasably attaching the strips to the board. It will be appreciated that the various areas for information on the board may be arranged in other suitable configuration.

Figure 9:
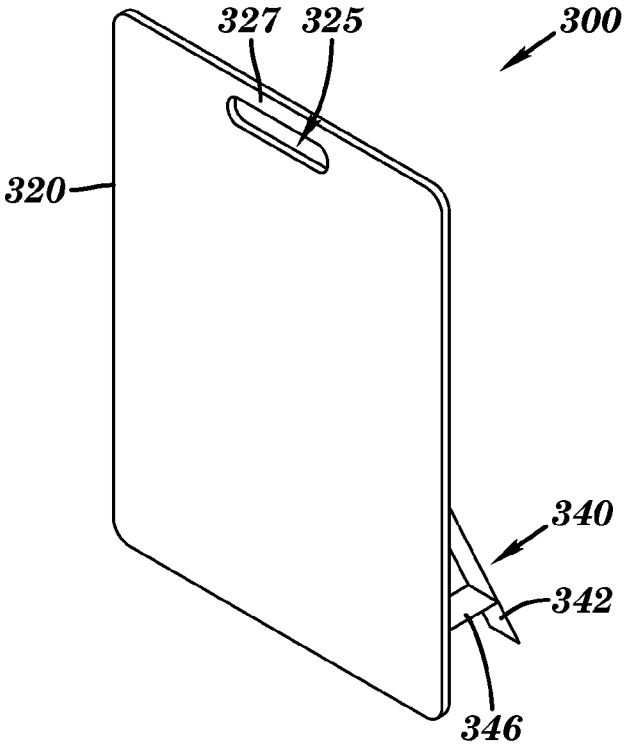
FIG. 9 is a perspective view of another embodiment of a dynamic prescription dispensing checklist system in accordance with aspects of the present disclosure.
Figure 10:
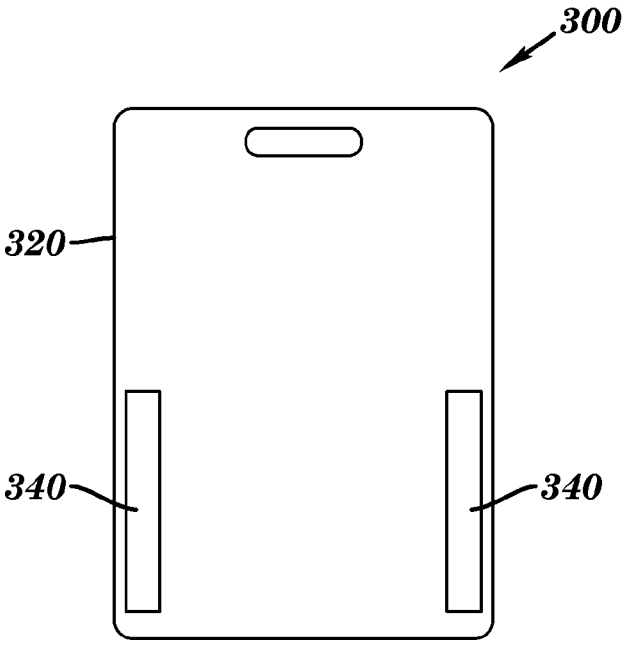
FIG. 10 is a rear elevational view of the dynamic prescription dispensing checklist system of FIG. 9.

FIG. 9 illustrates another embodiment of a dynamic prescription dispensing checklist system 300 in accordance with an aspect of the present disclosure. Dynamic prescription dispensing checklist system 300 may be essentially the same as or incorporated into system 20 described above. In this exemplary embodiment, dynamic prescription dispensing checklist system 300 includes a board 320 having an opening 325 defining a handle 327 along the top edge. Dynamic prescription dispensing checklist system 300 may also include one or more retractable, collapsible, or pop-up stands 340 (only one of which is shown in FIG. 9) which allows dynamic prescription dispensing checklist system 300 to be readily disposed generally upright on a surface such as a counter or a table. For example, stand 340 my include a first member 342 having an upper end pivotally attached to the back of the board, and a second member 346 pivotally attached to at one end to the back of the board, and pivotally attached at the other end to the first member 342. Second member 346 may be pivotally and fixedly attached to first member 342, and slidably attached and retained in a track along the back of board 320 allowing stand 340 to be collapsed against the back of the board. The first and second members may be disposed in a recess along the back of board 320 when not in use. As shown in FIG. 10, board 320 may include a pair of stands 340. Other suitable stands may be operably employed.

Figure 11:
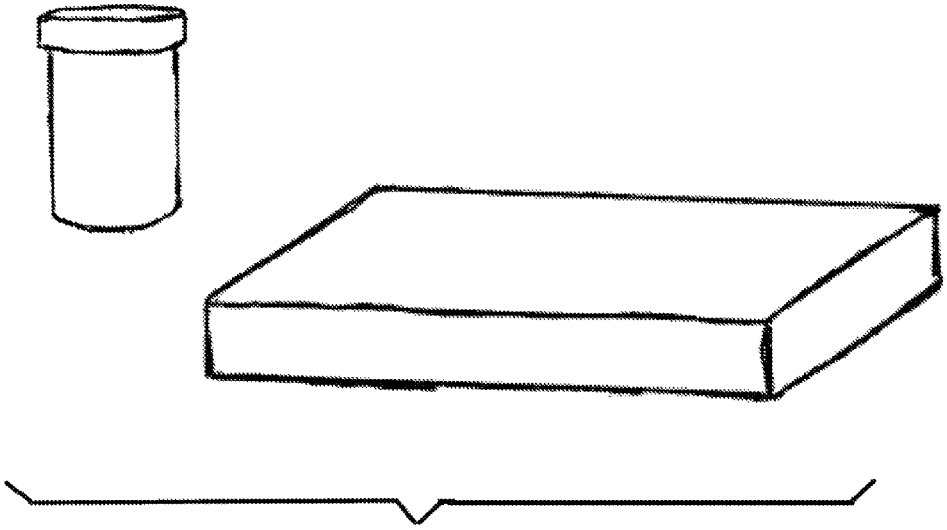
FIG. 11 is an illustration of a pill bottle and a container pill organizer.

FIG. 11 illustrates a pill bottle and a container or a pill organizer for use with the dynamic prescription dispensing checklist system.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the invention has been described in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that aspects of the disclosure may include only some of the described embodiments. Accordingly, the invention is not to be seen as limited by the foregoing description, but is only limited by the scope of the appended claims.

This written description uses examples to disclose the invention, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A dynamic prescription dispensing checklist system for use in filling a weekly or monthly pill organizer, said system comprising:

a board comprising a first surface having a first area identified for allowing a user to identify prescriptions, an area identified for allowing the user to identify times for taking the prescription, and a first area identified for allowing the user to removably mark said board upon dispensing pills into the weekly or monthly pill organizer;

said board comprising said first surface comprising a second area identified for allowing the user to identify prescription medications, and a second area identified for allowing the user to removably mark said board upon dispensing pills into the weekly or monthly pill organizer;

said first area identified for allowing the user to identify prescriptions, said area for allowing the user to identify times for taking the prescription, said first area identified for allowing the user to removably mark said board upon dispensing pills into the weekly or monthly pill organizer, and said second area identified for allowing the user to identify prescription medications, said second area identified for operably allowing the user to removably mark said board upon dispensing pills into the weekly or monthly pill organizer are disposed in side-by-side relationship;

a first plurality of strips movably and releasably attachable to said first surface of said board in said areas identified for identifying prescription medications, said first plurality of strips comprising a front surface operable for allowing the user to removably label prescription medications; and a second plurality of strips movably and releasably attachable to said first surface of said board in said area identified for identifying times for taking the prescription medications.

2. The system of claim 1 wherein said second plurality of strips comprises a front surface operable for allowing the user to removably label times for taking the prescription medications.

3. The system of claim 1 wherein, on said first surface, said first area identified for allowing the user to removably mark said board is disposed between said first area identified for allowing the user to identify prescription medications and said area identified for allowing the user to identify times for taking the prescription medications.

4. The system of claim 1 wherein, on said first surface, said areas comprise a plurality of columns.

5. The system of claim 1 further comprising, on said first surface, an area identified for operably allowing the user to removably mark a need for refilling the prescription medications.

6. The system of claim 1 wherein said first surface of said board comprises an erasable surface or a washable surface.

7. The system of claim 1 wherein said front surface of said first and second plurality of strips comprises an erasable surface or a washable surface.

8. The system of claim 1 wherein said first plurality of strips and said second plurality of strips are magnetically attachable to said board.

9. The system of claim 1 wherein said board comprises a second opposite surface comprising an area identified for allowing the user to label information relating to a patient.

10. The system of claim 1 wherein said board comprises a second opposite surface comprising an area identified for allowing the user to label information relating to at least one of prescription names, prescription refill numbers, doctors names and phone numbers, and pharmacy phone numbers.

11. The system of claim 1 wherein said board comprises a second opposite surface comprising an area identified for allowing the user to label information relating to prescription names, prescription refill numbers, doctors names and phone numbers, and pharmacy phone numbers.

12. The system of claim 1 further comprising, on said first surface, an area identified for operably allowing the user to removably mark the need for refilling the prescription medications, and said board comprising a second opposite surface comprising areas identified for allowing the user to identify prescription names, prescription refill numbers, pharmacy phone numbers, and marking a need for refilling the prescription medications.

13. The system of claim 1 wherein said board comprises an opening defining a handle for use in transporting the system.

14. The system of claim 1 wherein said board comprises at least one stand for supporting the board in a generally upright orientation.

15. A method for use in filling a weekly or monthly pill organizer, the method comprising:

providing the dynamic prescription dispensing checklist system comprising:

a board comprising a first surface having an area identified for allowing a user to identify prescriptions, an area identified for allowing the user to identify times for taking the prescription, and an area identified for allowing the user to removably mark said board upon dispensing pills into the weekly or monthly pill organizer;

a first plurality of strips movably and releasably attachable to said first surface of said board in said area identified for identifying prescription medications, said first plurality of strips comprising a front surface operable for allowing the user to removably label prescription medications; and a second plurality of strips movably and releasably attachable to said first surface of said board in said area identified for identifying times for taking the prescription medications;

obtaining a plurality of prescription medication pill bottles comprising pills for dispensing over a week or month;

labeling a name of the prescription medications on some of the first plurality of strips;

labeling times during the day for taking the prescription medications on the second plurality of strips;

placing the labeled first plurality of strips and the labeled second plurality of strips on the board so that the prescription medications of first plurality of strips for a day are coordinated with the times of the second plurality of strips;

removing a plurality of first pills from a first of the prescription pill bottles;

placing the plurality of first pills in respective container portions of a weekly or monthly pill organizer corresponding to the prescription medication and time identified on the dynamic prescription dispensing checklist system;

marking the dynamic prescription dispensing checklist system to identify that the first plurality of pills has been dispensed into the weekly or monthly pill organizer;

repeating the steps of removing, placing, and marking for the remaining plurality of prescription pill bottles;

removing the markings after completing the dispensing of the plurality of pills into the weekly or monthly pill organizer;

removing the plurality of pills from the weekly or monthly pill organizer over the course of the week or month; and repeating the steps of removing, placing, and marking to refill the pill organizer for the next weekly or monthly pill organizer.

16. The method of claim 15 further comprising receiving a new prescription, updating the dynamic prescription dispensing checklist system to add the new prescription, and dispensing the pills including the new prescription using the dynamic prescription dispensing checklist system for a day into the weekly or monthly pill organizer.

17. The method of claim 15 further comprising receiving a new prescription which changes the time of day for taking a current prescription, updating the dynamic prescription dispensing checklist system by moving the corresponding prescription medication to correspond to the new time of the day for taking the prescription, and dispensing the pills including the new prescription using the dynamic prescription dispensing checklist system for a day into the weekly or monthly pill organizer.

18. The method of claim 15 wherein the system comprises an area for operably allowing the user to removably mark the need for refilling the prescription medications, and further comprising marking the system to identify the need for refilling a prescription medication.

19. The method of claim 15 wherein the system comprises the board having a first surface having an area identified for operably allowing the user to removably mark the need for refilling the prescription medications, and the board having a second opposite surface having an area identified for operably allowing the user to removably mark the need for refilling the prescription medications in connection with prescription names, prescription refill numbers, and pharmacy phone numbers.

20. The method of claim 15 further comprising transporting the system from one location to a remote location.

* * * * *